US012410579B2

(12) United States Patent
Peddi

(10) Patent No.: US 12,410,579 B2
(45) Date of Patent: Sep. 9, 2025

(54) COUPLER UNIT FOR WORK MACHINE

(71) Applicant: Caterpillar Inc., Peoria, IL (US)

(72) Inventor: Rima Peddi, North Brunswick Township, NJ (US)

(73) Assignee: Caterpillar Inc., Peoria, IL (US)

( * ) Notice: Subject to any disclaimer, the term of this patent is extended or adjusted under 35 U.S.C. 154(b) by 446 days.

(21) Appl. No.: 17/938,359

(22) Filed: Oct. 6, 2022

(65) Prior Publication Data

US 2024/0117589 A1 Apr. 11, 2024

(51) Int. Cl.
*E02F 3/36* (2006.01)

(52) U.S. Cl.
CPC ..... *E02F 3/3631* (2013.01)

(58) Field of Classification Search
CPC ..... E02F 3/3631; E02F 3/3636
USPC ..... 414/723
See application file for complete search history.

(56) References Cited

U.S. PATENT DOCUMENTS 3,913,768 A * 10/1975 Grooss ..... E02F 3/3417 37/445
5,010,962 A * 4/1991 Bloom, Jr. ..... E02F 9/26 37/906
6,074,120 A 6/2000 Williams
6,158,917 A 12/2000 Wolin et al.
6,241,455 B1 6/2001 Schupback et al.
9,689,138 B2 6/2017 Seda et al.
10,106,950 B2 * 10/2018 Martin ..... E02F 3/3645
2007/0297888 A1 * 12/2007 Bystrom ..... E02F 3/3631 414/815
2015/0068073 A1 * 3/2015 Martin ..... E02F 3/3631 37/468
2015/0345104 A1 * 12/2015 Bradley ..... E02F 3/3622 414/723
2017/0107699 A1 4/2017 Alampalle

* cited by examiner

*Primary Examiner* — Saul Rodriguez
*Assistant Examiner* — Brendan P Tighe

(57) ABSTRACT

A coupler unit for coupling a work tool with a work machine includes a coupling bracket. The coupler unit includes a pin, at least one side plate, a boss extending from the side plate, and a slider movably coupled with the boss. Based on a contact of the work tool with the slider, the slider is configured to move relative to the boss from a first position to a second position. In the first position, the slider is misaligned relative to the boss and the side plate, and the slider prevents receipt of the pin within the boss and the side plate. In the second position, each of the coupling bracket, the slider, the boss, and the side plate are in alignment with each other, and the pin is receivable within each of the coupling bracket, the slider, the boss, and the side plate.

20 Claims, 8 Drawing Sheets

COUPLER UNIT FOR WORK MACHINE

TECHNICAL FIELD

The present disclosure relates to a coupler unit for a work machine, and more particularly, to the coupler unit for coupling a work tool with the work machine.

BACKGROUND

A work machine, such as, wheel loader typically includes a coupler unit. The coupler unit allows coupling of different work tools (or implements), such as, a bucket, a scooper, a blade, a backhoe, etc., with the work machine. Various coupler units and mechanisms have been devised to facilitate quick interchange of the work tools so as to enable use of the work machine for different work functions. The coupler unit includes a locking pin that allow a quick connection of the coupler unit with different work tools. The locking pin may be received within a bore of the work tool so as to couple the coupler unit with the work tool.

For the work tool to engage with the locking pin, the bore of the work tool needs to be in alignment with the locking pin. However, in some cases, the work tool may not be positioned appropriately relative to the coupler unit due to which the bore of the work tool may be misaligned in relation to the locking pin. In such cases, the locking pin may fully extend without engaging with the work tool. Generally, the coupler unit includes an indication system that generates an alert or indication when the locking pin has fully extended to notify an operator that the work tool is coupled with the coupler unit. However, current indication systems do not consider an engagement of the locking pin with the work tool. Thus, it may be likely that the locking pin may fully extend and trigger the indication system even when the locking pin is not engaged with the work tool, thereby providing a false coupling indication.

Overall, a misalignment of the work tool and the coupler unit may lead to a delay in coupling of work tools and may also increase a probability of false coupling indications by the indication system. Such false coupling indications may be misleading and may impact a reliability and usability of the coupler units, which may not be desirable. In some cases, the operator may have to get down from an operator cabin of the work machine and visually check whether the work tool is in alignment with the locking pin, which may increase downtime and may also involve additional operator efforts.

U.S. Patent Application 2017/0107699 describes a coupler unit for coupling a work tool to a machine. The coupler unit comprises an indicator coupled to the coupler unit and pivotable between a first position and a second position. The second position is indicative of the work tool coupled to the machine. A coupling member is movable by an actuator to couple the work tool to the machine. The coupling of the work tool by the coupling member causes the indicator to pivot from the first position to the second position.

SUMMARY OF THE DISCLOSURE

In an aspect of the present disclosure, a coupler unit for coupling a work tool with a work machine is provided. The work tool includes a coupling bracket. The coupler unit includes a pin configured to couple with the coupling bracket of the work tool. The coupler unit also includes at least one side plate. The coupler unit further includes a boss extending from the side plate. The coupler unit includes a slider movably coupled with the boss. Based on a contact of the work tool with the slider, the slider is configured to move relative to the boss from a first position to a second position. In the first position, the slider is misaligned relative to the boss and the side plate, and the slider prevents receipt of the pin within the boss and the side plate. In the second position, each of the coupling bracket, the slider, the boss, and the side plate are in alignment with each other, and the pin is receivable within each of the coupling bracket, the slider, the boss, and the side plate.

In another aspect of the present disclosure, a work machine is provided. The work machine includes a frame. The work machine also includes a linkage assembly coupled to the frame. The linkage assembly includes a work tool including a coupling bracket. The linkage assembly also includes a coupler unit configured to couple with the work tool. The coupler unit includes a pin configured to couple with the coupling bracket of the work tool. The coupler unit also includes at least one side plate. The coupler unit further includes a boss extending from the side plate. The coupler unit includes a slider configured to be movably coupled with the boss. Based on a contact of the work tool with the slider, the slider is configured to move relative to the boss from a first position to a second position. In the first position, the slider is misaligned relative to the boss and the side plate, and the slider prevents receipt of the pin within the boss and the side plate. In the second position, each of the coupling bracket, the slider, the boss, and the side plate are in alignment with each other, and the pin is receivable within each of the coupling bracket, the slider, the boss, and the side plate.

In yet another aspect of the present disclosure, a method of coupling a work tool with a work machine is provided. The work tool includes a coupling bracket. The method includes moving a coupler unit towards the work tool. The coupler unit includes at least one side plate, a boss extending from the side plate, and a slider movably coupled with the boss. In a first position of the slider, the slider is misaligned relative to the boss and the side plate. The method also includes contacting the work tool with the slider. The method further includes moving the slider relative to the boss from the first position to a second position based on the contact of the work tool with the slider. In the second position of the slider, each of the coupling bracket, the slider, the boss, and the side plate are in alignment with each other.

Other features and aspects of this disclosure will be apparent from the following description and the accompanying drawings.

DETAILED DESCRIPTION

Figure 1:
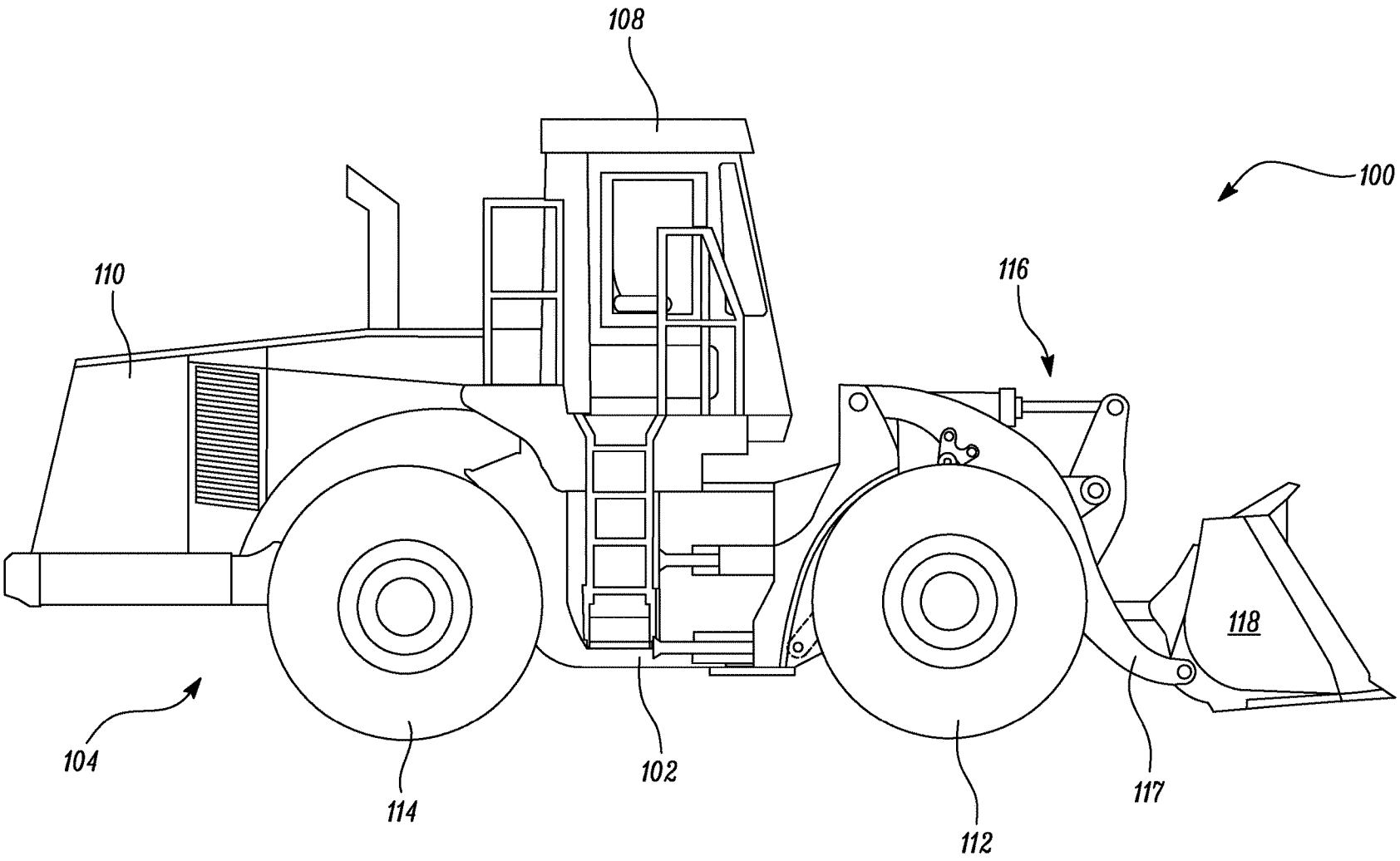
FIG. 1 is a schematic side view of a work machine, according to an embodiment of the present disclosure.

Wherever possible, the same reference numbers will be used throughout the drawings to refer to the same or like parts. Referring to FIG. 1, a schematic side view of an exemplary work machine 100 is illustrated. The work machine 100 is embodied as a wheel loader that may be used for purposes, such as, construction, landscaping, agriculture, and the like. Alternatively, the work machine 100 may be embodied as an off highway truck, a dozer, an excavator, a track-type tractor, a motor grader, etc. that may be used in various industries to move, remove, or load materials, such as, asphalt, debris, dirt, snow, feed, gravel, logs, raw minerals, recycled material, rock, sand, woodchips, etc.

The work machine 100 includes a frame 102. The frame 102 supports various components of the work machine 100. The work machine 100 defines a first side 104 (being visible, end on, in FIG. 1) and a second side opposite the first side 104. Further, the work machine 100 includes an operator cabin 108 supported by the frame 102. The operator cabin 108 may include one or more controls (not shown) that may enable an operator to control the work machine 100. The work machine 100 further includes a hood 110 mounted on the frame 102. Further, the work machine 100 includes a power source (not shown) supported by the frame 102. The power source may be disposed within the hood 110. The power source may include an engine, such as, an internal combustion engine, batteries, motors, and the like. The power source may provide power to various components of the work machine 100 for operational and mobility requirements.

The work machine 100 includes a pair of front wheels 112 and a pair of rear wheels 114. The front wheels 112 and the rear wheels 114 provide support and mobility to the work machine 100 on grounds. Alternatively, the work machine 100 may include tracks instead of the wheels 112, 114. The work machine 100 also includes a linkage assembly 116 coupled to the frame 102. The linkage assembly 116 is movably coupled to the frame 102. The linkage assembly 116 includes a pair of linkage arms 117 coupled to the frame 102 at one end thereof. The linkage assembly 116 also includes a coupler unit 120 (see FIGS. 2 and 3). The coupler unit 120 is omitted from FIG. 1 for clarity. The linkage assembly further includes a work tool 118. The work tool 118 may be used to perform work operations, such as, loading, stock piling, dumping, and the like. The work tool 118 is embodied as a bucket herein. Alternatively, the work tool 118 may be any other type of work tool known in the art, such as, a blade.

Figure 2:
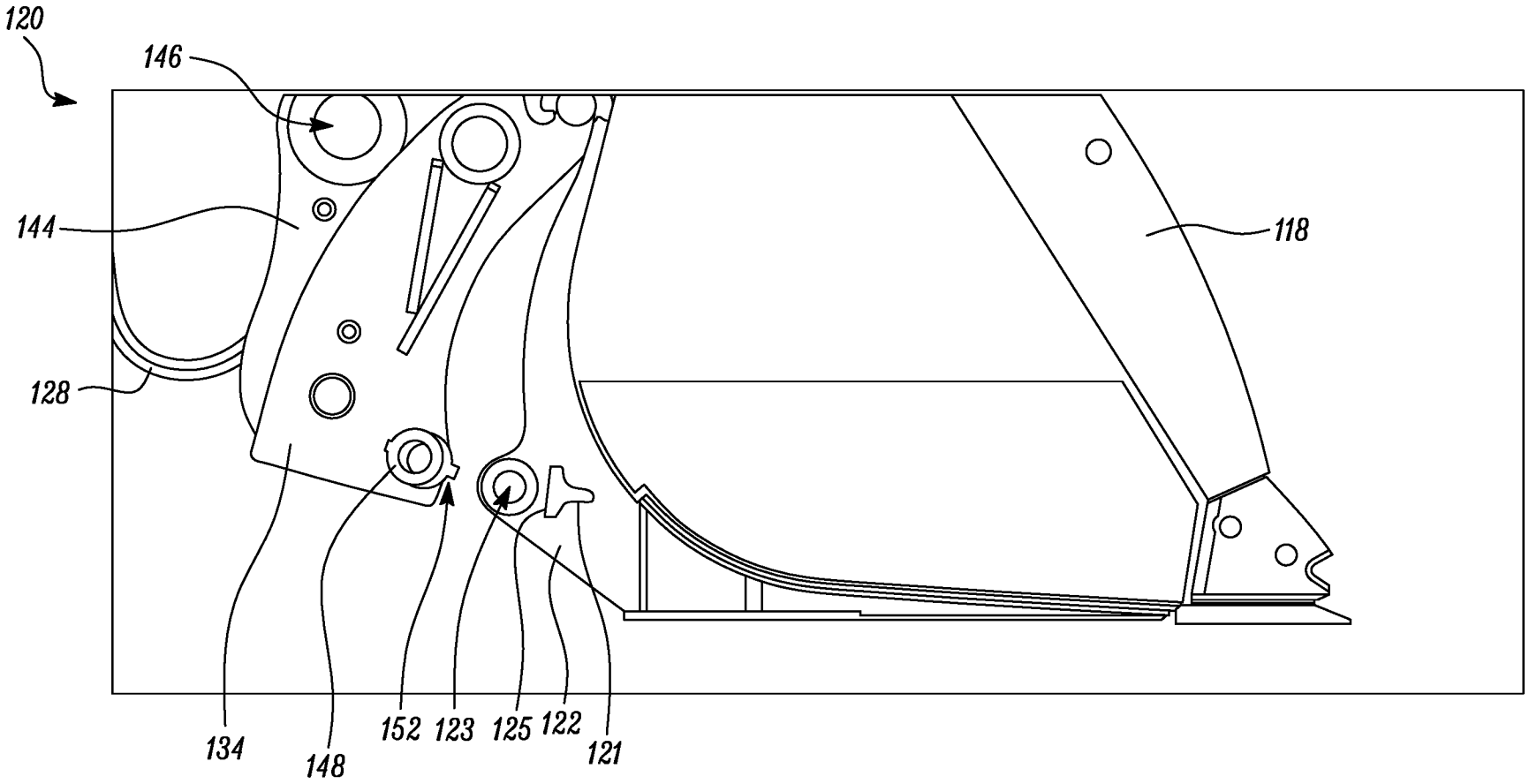
FIG. 2 is a schematic side view of a work tool and a coupler unit associated with the work machine of FIG. 1, according to an embodiment of the present disclosure.

FIG. 2 illustrates a schematic side view of the work tool 118. While the work tool 118 is depicted in whole, as viewed from the first side 104 (same as FIG. 1), a portion of the coupler unit 120, nearest the viewer, is cutaway to illustrate parts that are facing away from the first side 104 (as described in more detail below). The work tool 118 includes a coupling bracket 122. Specifically, the work tool 118 includes a pair of coupling brackets 122 (only one of which is illustrated herein). Each coupling bracket 122 defines a bore 123. The work tool 118 also includes a stopper 121. The stopper 121 may be fixedly coupled with the coupling bracket 122. In an example, a material of the stopper 121 may be same as a material of the work tool 118. The stopper 121 may be coupled to the coupling bracket 122 by welding, or any other fastening means, such as, a bolt, a screw, a rivet, and the like. The stopper 121 includes a flat profile 125. It should be noted that a design of the stopper 121 as illustrated herein is exemplary in nature, and the stopper 121 may include any other design.

Figure 3:
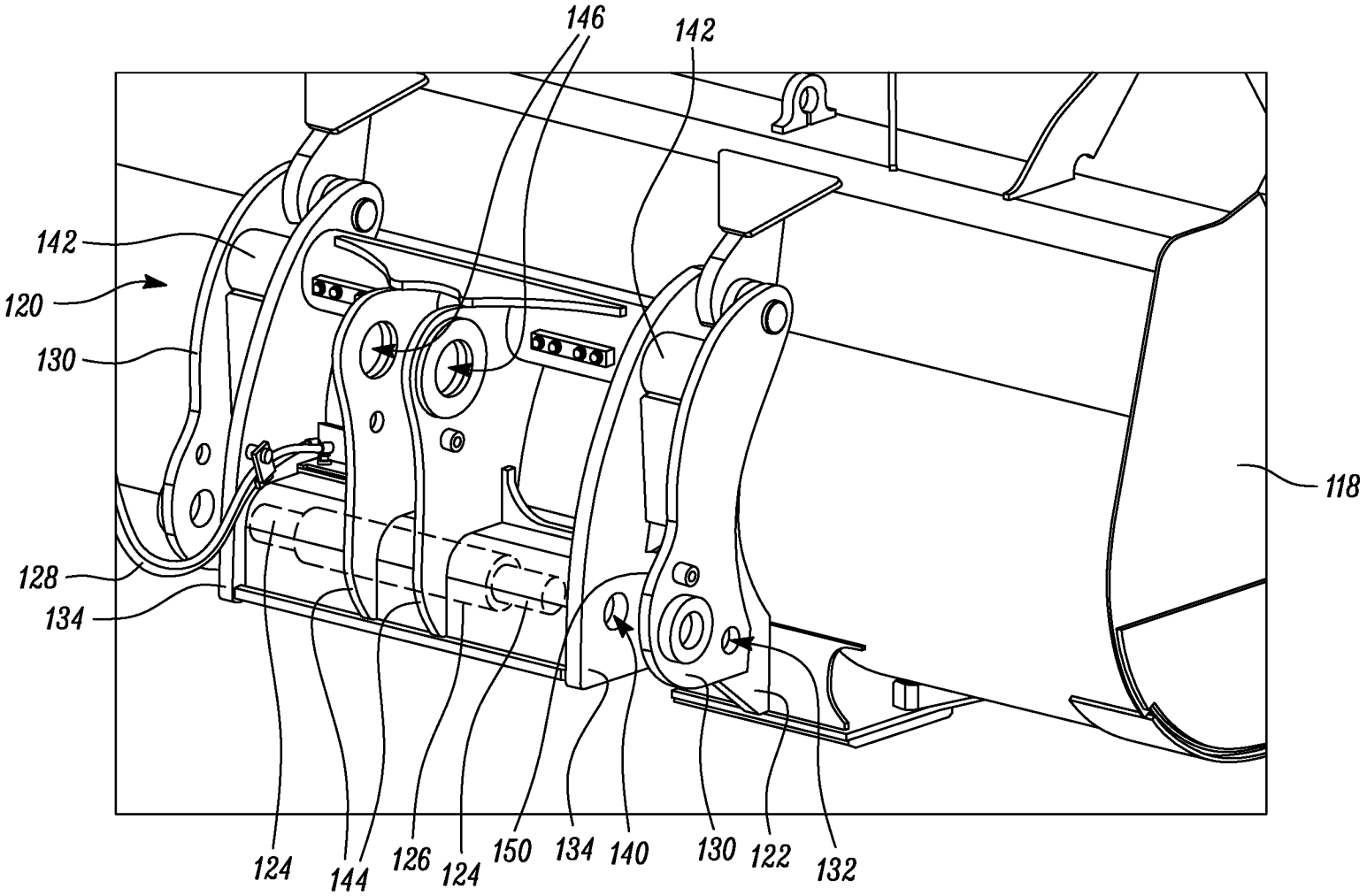
FIG. 3 is a schematic perspective view of the coupler unit coupled with the work tool.

Referring now to FIG. 3, the coupler unit 120 couples with the work tool 118. Specifically, the coupling brackets 122 of the work tool 118 allow coupling of the work tool 118 with the coupler unit 120. The linkage arms 117 (see FIG. 1) also couple with the coupler unit 120. Thus, the work tool 118 is movably coupled to the frame 102 (see FIG. 1), via the linkage arms 117 and the coupler unit 120.

As shown in FIG. 3, the coupler unit 120 includes a pin 124. The pin 124 couples with the coupling bracket 122 of the work tool 118. In the illustrated example, the pin 124 is cylindrical is shape. In other examples, the pin 124 may have any other shape or design, based on application attributes. It should be noted that the coupler unit 120 includes two pins 124. In some examples, the coupler unit 120 may include an indication system (not shown) that generates an alert or indication when the pin 124 is in a fully extended position.

The coupler unit 120 also includes an actuator 126. The pins 124 may extend/retract based on an actuation by the actuator 126. The actuator 126 may include a hydraulic actuator, a pneumatic actuator, or an electrical actuator. In the illustrated example, the actuator 126 is embodied as a hydraulic actuator. The actuator 126 is in fluid communication with fluid lines 128 to extend/retract the pins 124 based on variation in fluid pressure.

The coupler unit 120 further includes one or more side plates 130. In the illustrated example, the coupler unit 120 includes two side plates 130. Further, each side plate 130 includes a first opening 132 through which the pin 124 extends during the coupling of the work tool 118 with the coupler unit 120.

The coupler unit 120 also includes two primary plates 134 disposed proximate to a corresponding side plate 130. Further, each primary plate 134 includes a second opening 140 through which the pin 124 extends during the coupling of the work tool 118 with the coupler unit 120. It should be noted that, when the coupler unit 120 is to be coupled with the work tool 118, each pin 124 extends so that the pin 124 couples with a corresponding primary plate 134, a corresponding coupling bracket 122, and a corresponding side plate 130.

The coupler unit 120 also includes a bar 142 that rigidly connects the side plate 130 and the primary plate 134. The coupler unit 120 further includes a pair of secondary plates 144 having a pair of aligned openings 146. The secondary plates 144 couple the coupler unit 120 with the linkage arms 117.

Figure 4:
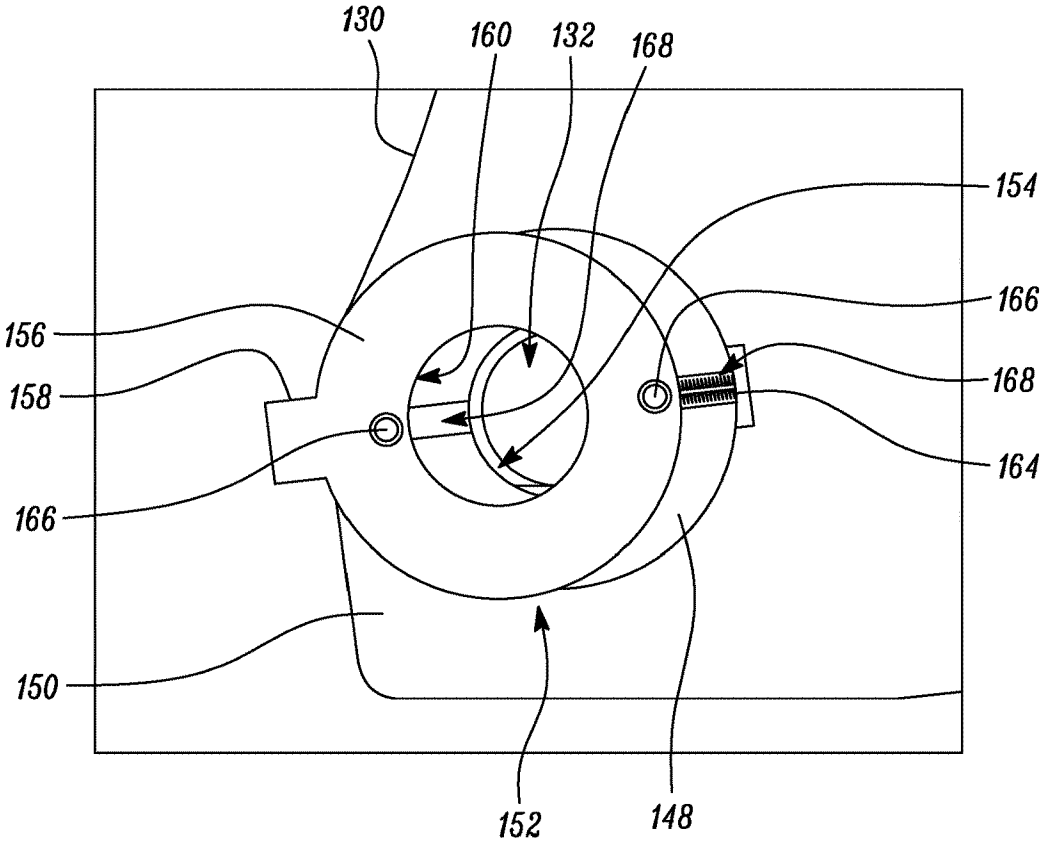
FIG. 4 is a schematic side view illustrating a slider of the coupler unit of FIG. 2 in a first position.

FIG. 4 illustrates a schematic side view of the coupler unit 120. In FIG. 4, the coupler unit 120 is viewed from the second side (opposite the point of view depicted in FIGS. 1 and 2). The coupler unit 120 includes a boss 148 extending from the side plate 130. Specifically, the boss 148 extends from an inner surface 150 of the side plate 130. It should be noted that the coupler unit 120 may include two bosses 148 (only one of which is illustrated herein), each of which is coupled to a corresponding side plate 130. The boss 148 defines a third opening 154. The boss 148 also defines one or more slots 168. Specifically, the boss 148 defines two slots 168 that are in alignment with each other. The slots 168 are substantially linear and are disposed proximate to the third opening 154.

The coupler unit 120 also includes a slider 152 movably coupled with the boss 148. It should be noted that the coupler unit 120 may include two sliders 152 (only one of which is illustrated herein), each of which is coupled to a corresponding boss 148. In an example, a material of the slider 152 may be same as a material of the coupler unit 120.

Based on a contact of the work tool 118 (see FIGS. 2 and 3) with the slider 152, the slider 152 moves relative to the boss 148 from a first position to a second position. The slider 152 is shown in the first position in FIG. 4. In FIG. 4, a movement of the slider 152, from the first position to the second position, from the perspective of the viewer, is generally in a direction from left to right, whereas, in FIG. 2, which is reversed, a movement of the slider 152 is in the opposite direction, e.g., being generally from right to left. The slider 152 defines a central opening 160. In the first position, the slider 152 is misaligned relative to the boss 148 and the side plate 130, and the slider 152 prevents receipt of the pin 124 (see FIG. 3) within the boss 148 and the side plate 130. In other words, in the first position of the slider 152, the central opening 160 of the slider 152 is misaligned relative to the third opening 154 of the boss 148 and the first opening 132 (see FIG. 3) of the side plate 130, thereby, preventing the extension of the pin 124 through the third opening 154 of the boss 148 and the first opening 132 of the side plate 130. Further, the misalignment of the slider 152 relative to the boss 148 prevents coupling of the coupler unit 120 to the work tool 118.

Figure 5:
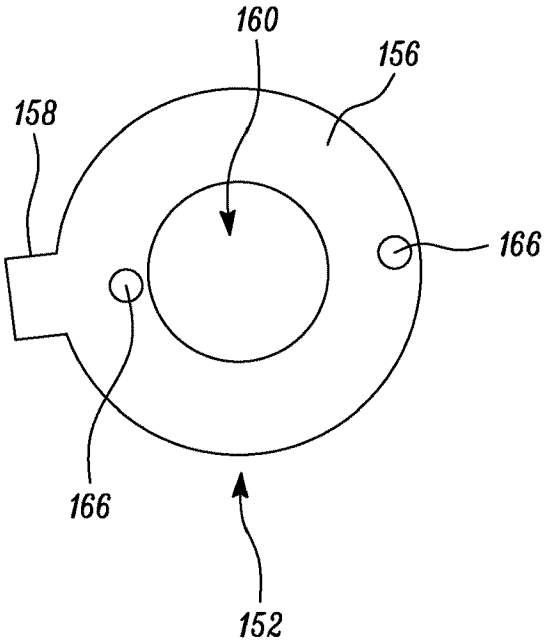
FIG. 5 is a schematic side view of the slider of FIG. 4.

FIG. 5 is a schematic side view of the slider 152. The slider 152 includes a body portion 156. The slider 152 also includes an engagement portion 158 extending from the body portion 156. The work tool 118 (see FIGS. 2 and 3) contacts the engagement portion 158 for moving the slider 152 from the first position to the second position. In the illustrated example, the engagement portion 158 is substantially rectangular in shape. In other examples, the engagement portion 158 may have any other shape such as, a square shape.

Referring now to FIGS. 4 and 5, the slider 152 includes one or more fasteners 166 to movably couple the slider 152 with the boss 148. Specifically, the slider 152 includes a pair of fasteners 166 that movably couple the slider 152 with the boss 148. The fasteners 166 are coupled with the body portion 156. Further, the fasteners 166 are received within the one or more slots 168 defined in the boss 148. Specifically, each fastener 166 is received within a corresponding slot 168. The fasteners 166 may include, for example, a screw, a bolt, or any other securing means that allows coupling of the slider 152 with the boss 148.

Referring again to FIG. 4, the coupler unit 120 further includes a spring 164 coupled with and extending between the body portion 156 and the boss 148. The spring 164 biases the slider 152 towards the first position. For example, the spring 164 moves the slider 152 to the first position when the work tool 118 is not in contact with the slider 152. In other words, when the work tool 118 is not in contact with the slider 152, the spring 164 moves the slider 152 to the first position so that the central opening 160 of the slider 152 is misaligned relative to the third opening 154 of the boss 148.

Figure 6:
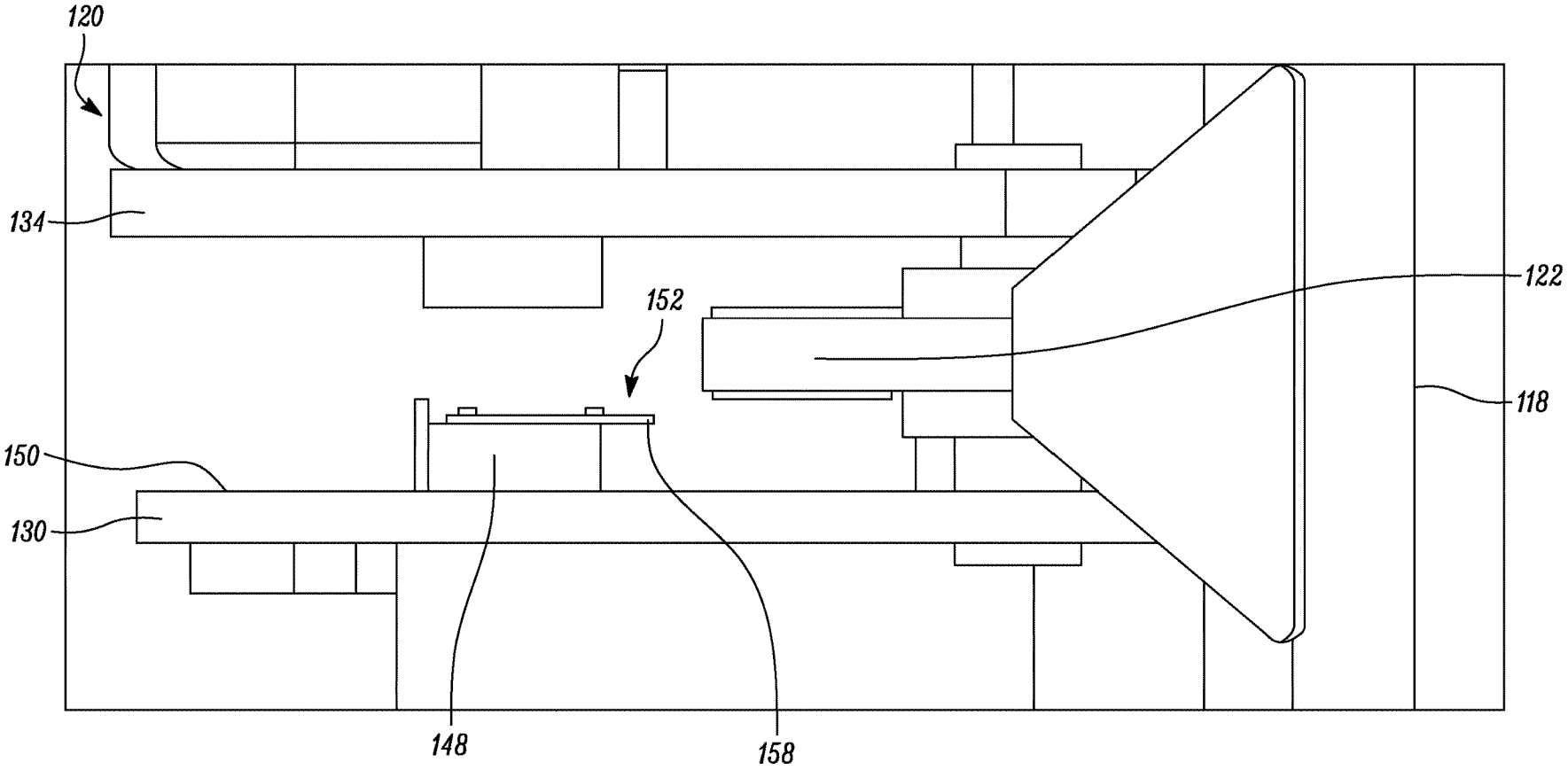
FIG. 6 is a schematic top view of the coupler unit wherein the slider is in the first position.

FIG. 6 is a schematic top view of the coupler unit 120 with the slider 152 in the first position. As stated earlier with respect to FIG. 4, and depicted from a different viewpoint in FIG. 6, in the first position of the slider 152, the slider 152 is misaligned relative to the boss 148 and the side plate 130. Thus, the slider 152 prevents receipt of the pin 124 (see FIG. 3) within the boss 148 and the side plate 130.

Figure 7:
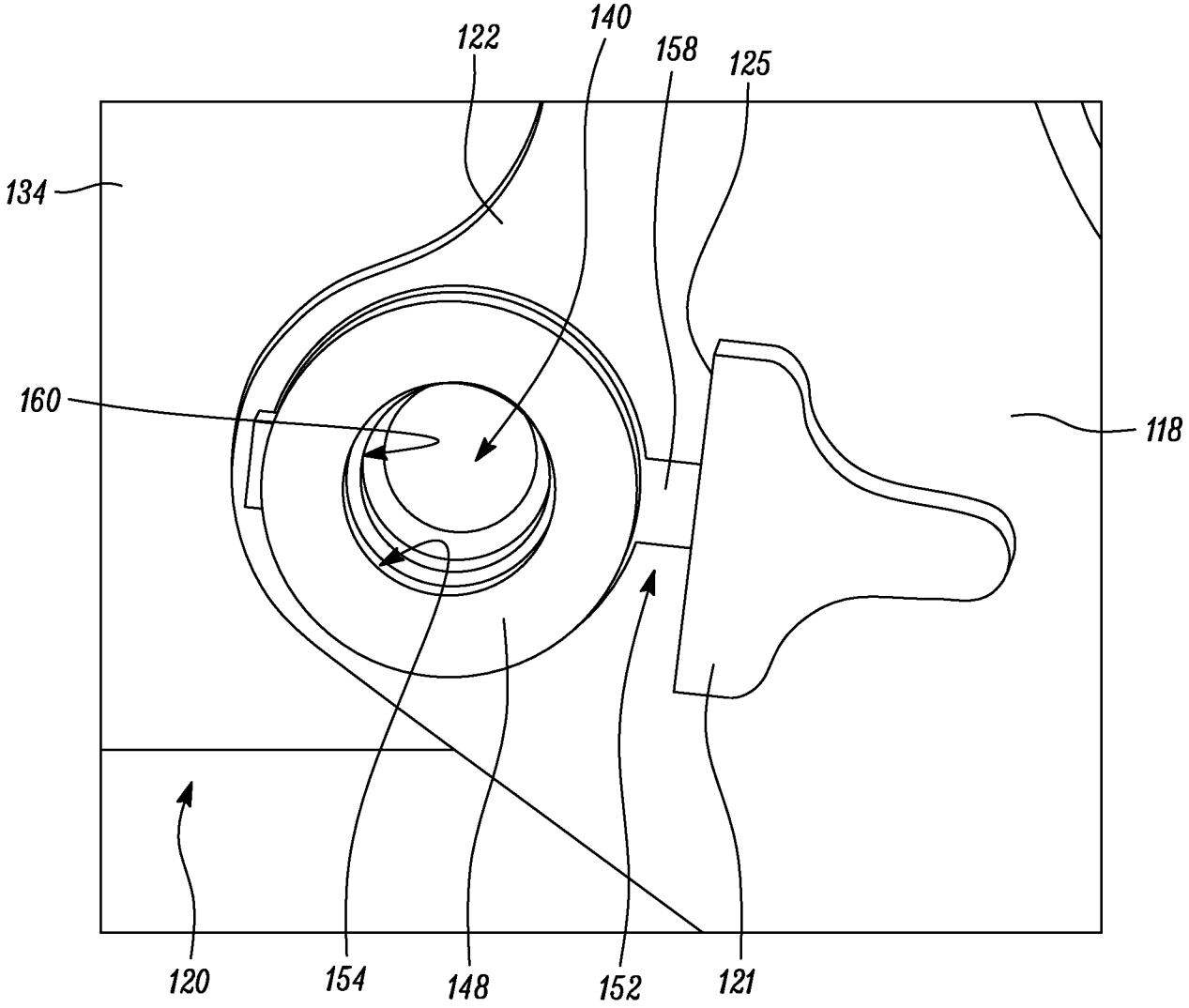
FIG. 7 is a schematic side view of the slider in a second position, according to an embodiment of the present disclosure.

FIG. 7 is a schematic side view of the slider 152 in the second position. Referring now to FIG. 7, like in FIG. 2, the boss 148 is sectioned through and the side plate 130, nearest the viewer, is cutaway to illustrate the boss 148 and the slider 152, which are attached to the inner surface 150 of the side plate 130 that is facing away from the first side 104. In FIG. 7, the work tool 118 contacts the engagement portion 158 for moving the slider 152 from the first position to the second position. Particularly, the work tool 118 includes the stopper 121 that contacts with the slider 152 for moving the slider 152 from the first position to the second position. As illustrated in FIG. 7, the flat profile 125 of the stopper 121 contacts the engagement portion 158, which causes the slider 152 to move to the second position. In the second position, each of the coupling bracket 122, the slider 152, the boss 148, and the side plate 130 (see FIG. 4) are in alignment with each other. Further, the pin 124 (see FIG. 3) is receivable within each of the coupling bracket 122, the slider 152, the boss 148, and the side plate 130. Thus, when the stopper 121 of the work tool 118 pushes the slider 152 to the second position, the second opening 140 (see FIG. 3) of the primary plate 134 (see FIG. 3), the bore 123 of the coupling bracket 122 (also visible in FIG. 2), the central opening 160 of the slider 152, the third opening 154 of the boss 148, and the first opening 132 (see FIG. 4) of the side plate 130 are in alignment with each other.

Figure 8:
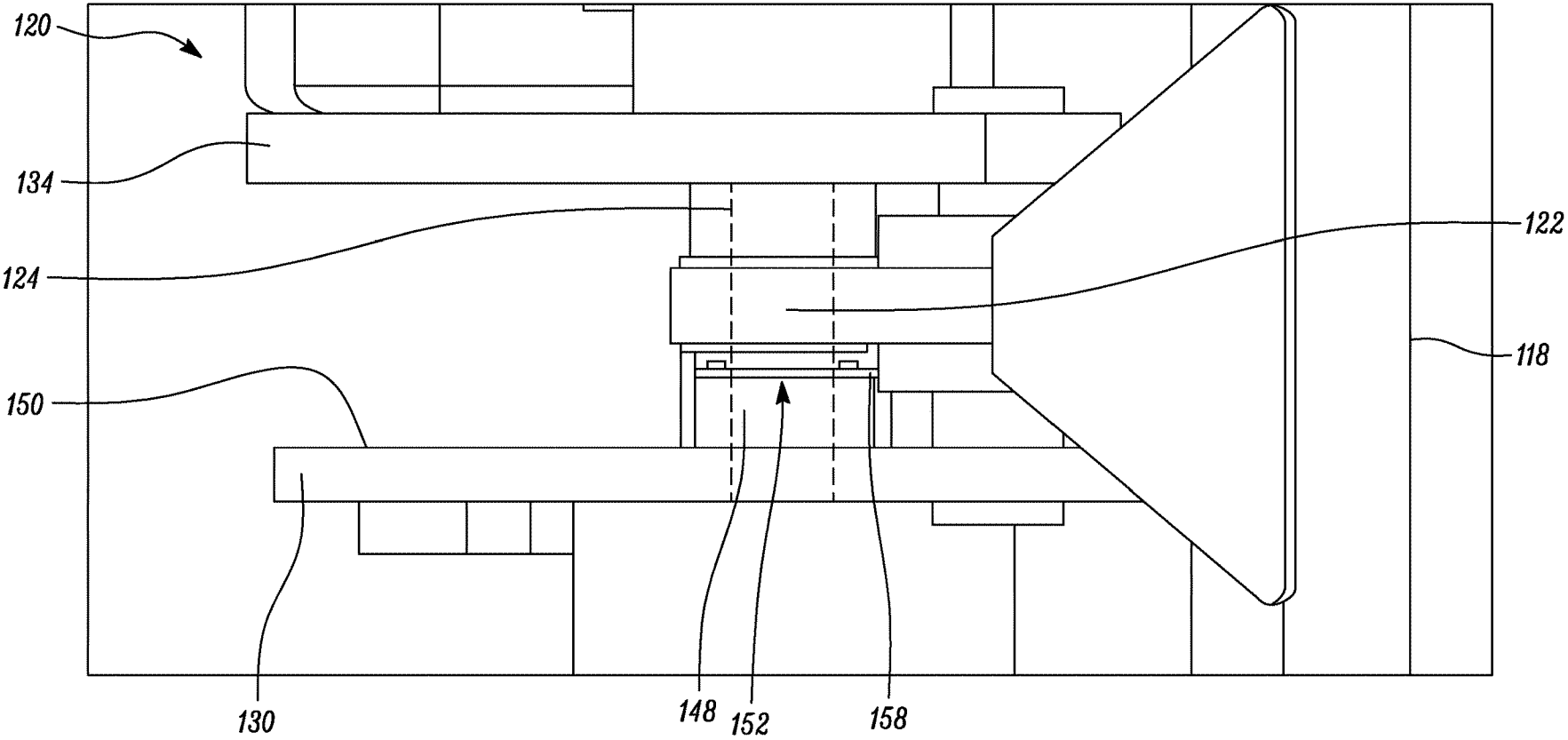
FIG. 8 is a schematic top view of the coupler unit coupled with the work tool when the slider is in the second position.

Referring now to FIG. 8, when the slider 152 is in the second position and the pin 124 (shown with dashed lines) is extended, the pin 124 may couple with each of the primary plate 134, the coupling bracket 122, the slider 152, the boss 148, and the side plate 130, thereby coupling the coupler unit 120 with the work tool 118.

It should be noted the coupler unit 120 with the work tool 118 has a symmetric design. Accordingly, only the details of the coupler unit 120 with the work tool 118 disposed at the first side 104 (see FIG. 1) of the work machine 100 have been described herein. However, the details provided herein are equally applicable to the coupler unit 120 with the work tool 118 disposed at the second side of the work machine 100, without any limitations thereto.

It is to be understood that individual features shown or described for one embodiment may be combined with individual features shown or described for another embodiment. The above described implementation does not in any way limit the scope of the present disclosure. Therefore, it is to be understood although some features are shown or described to illustrate the use of the present disclosure in the context of functional segments, such features may be omitted from the scope of the present disclosure without departing from the spirit of the present disclosure as defined in the appended claims.

INDUSTRIAL APPLICABILITY

The coupler unit 120 of the present disclosure allows coupling of various work tools with the work machine 100. The coupler unit 120 includes the slider 152 movably coupled with the boss 148. The slider 152 is movable between the first and second positions. The first position of the slider 152 may be indicative of a misalignment of the bore 123 of the coupling bracket 122 relative to the pin 124. If the work tool 118 is not in contact with the slider 152, the slider 152 may be in the first position and may prevent the extension of the pin 124 through the boss 148 and the side plate 130. In other words, the slider 152 may prevent a full extension of the pin 124 when the work tool 118 is not in contact with the coupler unit 120. Moreover, as the pin 124 does not extend fully due to the slider 152, the pin 124 may not trigger the indication system of the coupler unit 120, thereby preventing any generation of false coupling indications by the indication system.

Further, when the coupler unit 120 is moved towards the work tool 118, the stopper 121 of the work tool 118 contacts the slider 152 and pushes the slider 152 to the second position. Moreover, at such an instance, the bore 123 of the coupling bracket 122 aligns with the pin 124. Thus, in the second position of the slider 152, the bore 123 of the coupling bracket 122, the central opening 160 of the slider 152, the third opening 154 of the boss 148, and the first opening 132 of the side plate 130 are in alignment with each other, and the pin 124 may extend therethrough thereby allowing coupling of the coupler unit 120 with the work tool 118.

The coupler unit 120 of the present disclosure may help in coupling the work tool 118 with the coupler unit 120 in lesser time. Since the slider 152 of the coupler unit 120 ensures, structurally and/or mechanically, the alignment of the pin 124 with the work tool 118, the operator may not have to visually check for the misalignment, which may save operator efforts. The coupler unit 120 may be retrofitted on existing coupler units by performing minimal modifications on the coupler units. Further, the coupler unit 120 having the slider 152 may be reliable and may also exhibit improved usability.

Figure 9:
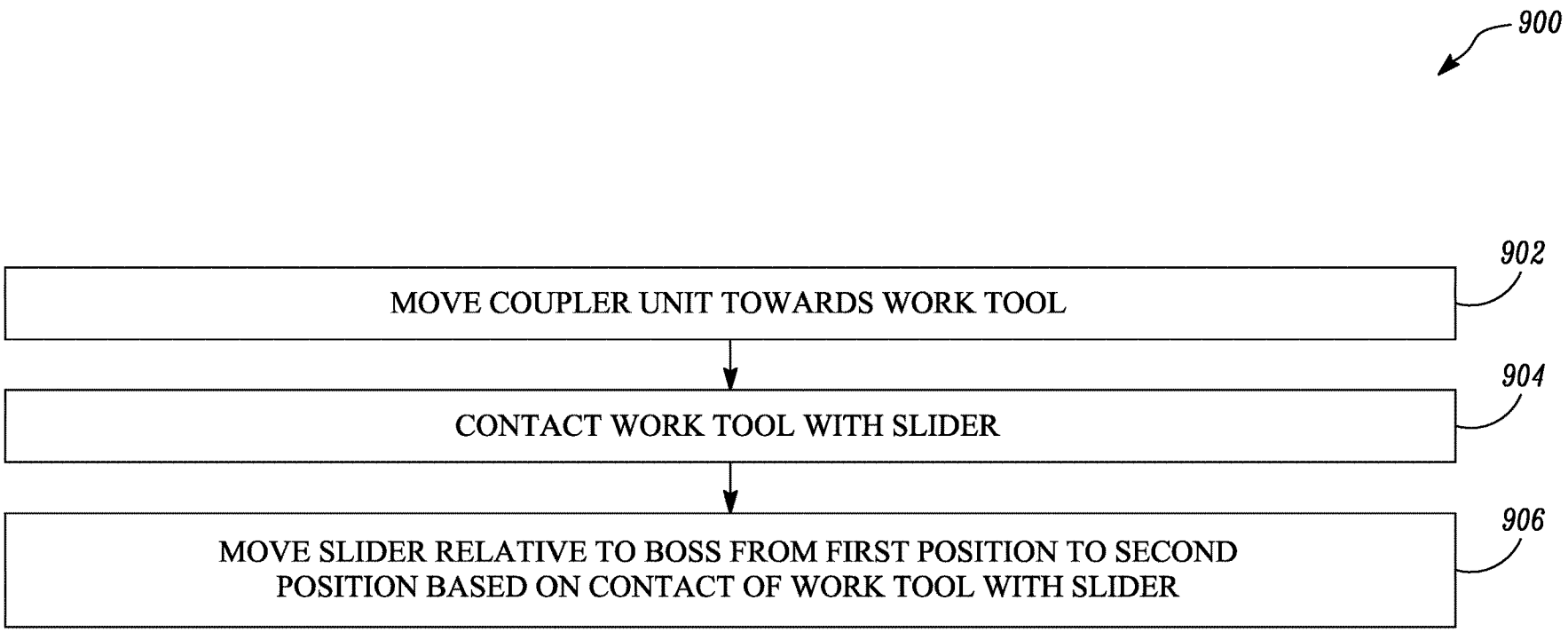
FIG. 9 is a flowchart for a method of coupling the work tool with the work machine of FIG. 1, according to an embodiment of the present disclosure.

Referring to FIG. 9, a flowchart for a method 900 of coupling the work tool 118 with the work machine 100 is illustrated. At step 902, the coupler unit 120 is moved towards the work tool 118. The work tool 118 includes the coupling bracket 122. The coupler unit 120 includes the side plate 130, the boss 148 extending from the side plate 130, and the slider 152 movably coupled with the boss 148. In the first position of the slider 152, the slider 152 is misaligned relative to the boss 148 and the side plate 130.

At step 904, the work tool 118 contacts with the slider 152. The slider 152 includes the body portion 156 and the engagement portion 158 extending from the body portion 156. Further, contacting the work tool 118 with the slider 152 includes contacting the stopper 121 of the work tool 118 with the engagement portion 158.

At step 906, the slider 152 is moved relative to the boss 148 from the first position to the second position based on the contact of the work tool 118 with the slider 152. In the second position of the slider 152, each of the coupling bracket 122, the slider 152, the boss 148, and the side plate 130 are in alignment with each other. Further, moving the slider 152 relative to the boss 148 also includes moving the fastener 166 coupled with the body portion 156 within the slot 168 defined in the boss 148. Additionally, moving the slider 152 relative to the boss 148 includes retracting the spring 164 coupled with and extending between the body portion 156 and the boss 148.

Further, the pin 124 of the coupler unit 120 is extended based on the movement of the slider 152 from the first position to the second position. Moreover, the pin 124 is received within each of the coupling bracket 122, the slider 152, the boss 148, and the side plate 130 for coupling the work tool 118 with the work machine 100.

Further, the slider 152 prevents the extension of the pin 124 when the work tool 118 is misaligned relative to the pin 124. Moreover, when the work tool 118 is misaligned relative to the pin 124, the generation of a false coupling indication of the engagement of the pin 124 and the work tool 118 is prevented based on the prevention of the extension of the pin 124.

While aspects of the present disclosure have been particularly shown and described with reference to the embodiments above, it will be understood by those skilled in the art that various additional embodiments may be contemplated by the modification of the disclosed work machine, systems and methods without departing from the spirit and scope of the disclosure. Such embodiments should be understood to fall within the scope of the present disclosure as determined based upon the claims and any equivalents thereof.

What is claimed is:

1. A coupler unit for coupling a work tool with a work machine, the work tool including a coupling bracket, the coupler unit comprising:
- a pin configured to couple with the coupling bracket of the work tool;
- at least one side plate;
- a boss extending from the side plate; and
- a slider movably coupled with the boss, the slider including an opening therethrough,
- wherein, based on a contact of the work tool with the slider, the slider is configured to move relative to the boss from a first position to a second position,
- wherein, in the first position, the opening of the slider is misaligned relative to the boss and the side plate, and the slider prevents receipt of the pin within the boss and the side plate, and
- wherein, in the second position, each of the coupling bracket, the opening of the slider, the boss, and the side plate are in alignment with each other, and the pin is receivable within each of the coupling bracket, the opening of the slider, the boss, and the side plate.

2. The coupler unit of claim 1, wherein the slider includes:
- a body portion; and
- an engagement portion extending from the body portion, wherein the work tool is configured to contact the engagement portion for moving the slider from the first position to the second position.

3. The coupler unit of claim 2, further comprising a spring coupled with and extending between the body portion and the boss.

4. The coupler unit of claim 3, wherein the spring is configured to move the slider to the first position when the work tool is not in contact with the slider.

5. The coupler unit of claim 2, wherein the slider includes at least one fastener configured to movably couple the slider with the boss, and wherein the fastener is coupled with the body portion.

6. The coupler unit of claim 5, wherein the fastener is configured to be received within at least one linear slot defined in the boss and the slider slides along the linear slot.

7. The coupler unit of claim 1, wherein the work tool includes a stopper configured to contact with the slider for moving the slider from the first position to the second position.

8. A work machine comprising:
- a frame; and
- a linkage assembly coupled to the frame, the linkage assembly including:
  - a work tool including a coupling bracket; and
  - a coupler unit configured to couple with the work tool, the coupler unit including:
    - a pin configured to couple with the coupling bracket of the work tool;
    - at least one side plate;

a boss extending from the side plate, the boss including a linear slot; and a slider slidably coupled to the slot of the boss, wherein, based on a contact of the work tool with the slider, the slider is configured to slide along the slot of the boss from a first position to a second position, wherein, in the first position, the slider is misaligned relative to the boss and the side plate, and the slider prevents receipt of the pin within the boss and the side plate, and wherein, in the second position, each of the coupling bracket, the slider, the boss, and the side plate are in alignment with each other, and the pin is receivable within each of the coupling bracket, the slider, the boss, and the side plate.

9. The work machine of claim 8, wherein the slider includes:

a body portion; and an engagement portion extending from the body portion, wherein the work tool is configured to contact the engagement portion for moving the slider from the first position to the second position.

10. The work machine of claim 9, wherein the slider further includes a spring coupled with and extending between the body portion and the boss.

11. The work machine of claim 10, wherein the spring is configured to move the slider to the first position when the work tool is not in contact with the slider.

12. The work machine of claim 8, wherein the slider includes an opening therethrough, and wherein in the second position, the coupling bracket, the opening of the slider, the boss, and the side plate are in alignment with each other, and the pin is receivable within each of the coupling bracket, the opening of the slider, the boss, and the side plate.

13. The work machine of claim 12, wherein in the second position, the pin passes through the opening of the slider.

14. The work machine of claim 8, wherein the work tool includes a stopper configured to contact with the slider for moving the slider from the first position to the second position.

15. A method of coupling a work tool with a work machine, the work tool including a coupling bracket, the method comprising:

moving a coupler unit towards the work tool, the coupler unit including at least one side plate, a boss extending from the side plate, and a slider movably coupled with the boss, the slider including an opening therethrough, wherein, in a first position of the slider, the opening of the slider is misaligned relative to the boss and the side plate;

contacting the work tool with the slider; and moving the slider relative to the boss from the first position to a second position based on the contact of the work tool with the slider, wherein, in the second position of the slider, each of the coupling bracket, the opening of the slider, the boss, and the side plate are in alignment with each other.

16. The method of claim 15, wherein the slider includes a body portion and an engagement portion extending from the body portion, and wherein contacting the work tool with the slider further includes contacting a stopper of the work tool with the engagement portion.

17. The method of claim 16, wherein moving the slider relative to the boss further includes moving at least one fastener coupled with the body portion within at least one slot defined in the boss.

18. The method of claim 16, wherein moving the slider relative to the boss further includes retracting a spring coupled with and extending between the body portion and the boss.

19. The method of claim 15 further comprising:

extending a pin of the coupler unit based on the movement of the slider from the first position to a second position; and receiving the pin within each of the coupling bracket, the opening of the slider, the boss, and the side plate for coupling the work tool with the work machine.

20. The method of claim 19, further comprising:

preventing, by the slider, an extension of the pin when the work tool is misaligned relative to the pin; and preventing, when the work tool is misaligned relative to the pin, a generation of a false coupling indication of an engagement of the pin and the work tool based on the prevention of the extension of the pin.

* * * * *